US010791812B2

(12) United States Patent
Steinkraus

(10) Patent No.: US 10,791,812 B2
(45) Date of Patent: Oct. 6, 2020

(54) ROLLABLE PERSONAL CONTAINER TRANSPORT DEVICE WITH ROTATING PLATFORM

(71) Applicant: William Eun-Se Steinkraus, Fort Lee, NJ (US)

(72) Inventor: William Eun-Se Steinkraus, Fort Lee, NJ (US)

( * ) Notice: Subject to any disclaimer, the term of this patent is extended or adjusted under 35 U.S.C. 154(b) by 247 days.

(21) Appl. No.: 15/624,120

(22) Filed: Jun. 15, 2017

(65) Prior Publication Data

US 2018/0360183 A1 Dec. 20, 2018

(51) Int. Cl.
*A45C 13/38* (2006.01)
*A45C 5/14* (2006.01)

(52) U.S. Cl.
CPC ..... *A45C 13/385* (2013.01); *A45C 5/14* (2013.01); *A45C 2005/148* (2013.01)

(58) Field of Classification Search
CPC .. B60R 9/065; A45C 7/00; A45C 5/04; A45C 5/14; A45C 5/146; A45C 13/385; A45C 13/38; A45C 13/262
USPC ..... 190/15.1, 18 A, 11, 18 R, 108, 1; 280/47.26, 37, 30, 87.041
See application file for complete search history.

(56) References Cited

U.S. PATENT DOCUMENTS 3,314,494 A 4/1967 Weitzner
3,935,613 A * 2/1976 Kaneko ..... A45C 5/143 16/30
4,054,965 A 10/1977 Vig et al.
4,072,319 A * 2/1978 Berger ..... A45C 13/385 280/47.24
5,291,976 A 3/1994 Ku
6,471,019 B1 * 10/2002 Miller ..... A45C 15/00 190/10
6,688,614 B2 * 2/2004 Hsu ..... A45C 5/146 280/37
8,201,837 B2 * 6/2012 Dweek ..... A45C 5/146 224/153
8,282,113 B2 * 10/2012 Veal ..... A45C 5/14 280/43.1
8,540,063 B2 * 9/2013 LaTowsky ..... A45C 5/14 190/18 A
8,893,937 B1 * 11/2014 Bristol ..... B62B 5/068 224/153
8,955,656 B1 2/2015 Foster et al.
9,033,350 B2 5/2015 Porri
9,629,430 B1 * 4/2017 Getahun ..... A45C 9/00
2005/0258621 A1 * 11/2005 Johnson ..... B62B 1/12 280/651
2010/0044174 A1 * 2/2010 Graf Von Bismarck ..... A45C 5/146 190/18 A
2011/0155527 A1 * 6/2011 Veal ..... A45C 5/14 190/18 A
2011/0247910 A1 10/2011 Darvish et al.
(Continued)

FOREIGN PATENT DOCUMENTS

EP 2540604 A1 1/2013

*Primary Examiner* — Sue A Weaver
(74) *Attorney, Agent, or Firm* — Vidas Arrett & Steinkraus P.A.

(57) ABSTRACT

A rollable personal container transport device that includes a platform that is rotatably movable from a closed position adjacent a back side of the device to an open position extending beyond a front of the device to provide a surface for carrying additional items.

20 Claims, 8 Drawing Sheets

(56) References Cited

U.S. PATENT DOCUMENTS

| | | | | |
|---|---|---|---|---|
| 2013/0062377 | A1* | 3/2013 | Turner | B62K 3/002 224/276 |
| 2014/0190780 | A1* | 7/2014 | Blazure | A45C 5/146 190/1 |
| 2015/0034402 | A1* | 2/2015 | Dourado | A45F 3/04 180/181 |
| 2015/0208776 | A1* | 7/2015 | Bennett | A45C 9/00 190/15.1 |
| 2016/0309867 | A1* | 10/2016 | Oberg | B62B 1/12 |
| 2017/0172266 | A1* | 6/2017 | Moskowitz | A45C 5/14 |
| 2018/0242707 | A1* | 8/2018 | Abrahamyan-Smith | A45C 15/00 |
| 2018/0271240 | A1* | 9/2018 | Miles | A45C 7/0022 |

* cited by examiner

ROLLABLE PERSONAL CONTAINER TRANSPORT DEVICE WITH ROTATING PLATFORM

CROSS REFERENCE TO RELATED APPLICATIONS

Not applicable.

STATEMENT OF FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING

Not applicable

BACKGROUND OF THE INVENTION

The invention relates to rollable personal container transport devices such as luggage, tool boxes and the like. The art has recognized that travelers who use rollable luggage often need to carry additional items of luggage or personal effects and the need for rollable luggage designs that can accommodate such additional items while pulling the luggage thorough airports to surface transport and to rooms at hotels and the like. Workers bringing wheelable tool boxes to worksites often have additional items that must be transported and that can require multiple trips between a vehicle and the worksite.

Prior patent documents describing the problem and offering other solutions include:

U.S. Pat. No. 5,291,976 "Wheeled suitcase of luggage support with collapsible towing handle" uses a strap to attach a second suitcase.

U.S. Pat. No. 8,955,656 "Luggage table" uses a table mountable on a suitcase to hold personal items while in airport.

US 20110247910 "Luggage with Deployable Undercarriage" describes, according to the Abstract, > "A luggage with a deployable, wheeled undercarriage and movable handles. The undercarriage has telescoping support members that can be deployed or opened to carry additional baggage and closed when not required. Wheels on the support members allow the luggage to be moved along the floor without having to tilt the luggage."

Quoting further from the background of US 20110247910:

Travelers are always looking for efficient and easy ways for carrying their baggage. Many times people in airports are trying to pull at least two suitcases at a time, as well as a small carry-on bag, briefcase, laptop, purse, cameras, etc. In addition, parents have to manage their children who also may have their own luggage and toys.

Wheeled suitcases with telescopic handles are now the norm. This allows the traveler to tilt the suitcase onto its rear wheels and pull the suitcase by the handle so that the traveler does not have to lift the suitcase. This may be acceptable for the light traveler; however, for travelers going on extended vacations with multiple baggages, the simple suitcase with wheels and a telescopic handle just is not enough.

Travelers may try to stack additional baggage on top of the rolling suitcase. Some suitcases even come with support members that extend from the front to increase the surface area for stacking. However, the support members are weak and are limited in the amount of baggage that can be placed on them. In addition, the stacked baggage is often times unsteady, and when the traveler comes to a stop and needs to rest, resetting the baggage into the vertical position causes all the stacked baggage to fall off.

In some instances, the traveler may rent a cart at an airport, if available. However, when the traveler is finished using the cart, the cart must be returned. Therefore, the rental of a cart can be costly, and is definitely inconvenient.

"[0007] For the foregoing reasons there is a need for a luggage that allows the traveler to carry multiple baggage easily and effectively."

While the problem to which the invention is directed has been recognized, the solutions provided in the prior art are not fully satisfactory.

Retractable platforms that allow a person to ride a piece of luggage are disclosed in U.S. Pat. No. 3,314,494 Collapsible luggage scooter; U.S. Pat. No. 8,282,113 Rideable luggage; U.S. Pat. No. 9,033,350 (EP 2540604) Luggage scooter device. These platforms likewise are not satisfactory if they were to be repurposed as platforms for carrying additional luggage.

BRIEF SUMMARY OF THE INVENTION

The inventor discloses herein rollable personal container transport devices such as rollable luggage with a platform that is rotatably movable through an angle (or instance of about 270°), from a closed position adjacent a back side of the device to an open position extending generally along the ground beyond the front of the luggage to provide a surface for carrying additional items of luggage or personal effects. The platform includes a pair of caster wheels at the upper side in the closed position that project downward in the open position to contact the ground. The platform is coaxially mounted with a pair of rear wheels of the transport device. The platform includes a pair of caster wheels at the upper side in the closed position that project downward in the open position to contact the ground.

In preferred embodiments, a back-parallel plane B running through the rear wheel axis and parallel to the back side is coplanar with a plumb plane P running through rear wheel axis and at right angle to the ground or floor plane F and both planes B and P are coplanar with a platform-parallel plane D running through the rear wheel axis and parallel to the platform outer edge when the platform is the closed position, but when the platform is rotated to the open position the back-parallel plane B deviates several degrees off parallel to said plumb plane P in the direction of rotation of the platform. This deviation allows the device to more easily be pushed and pulled when the platform is loaded.

In some embodiments, the back of the platform suitably has a deviation angle of from about 5°-10° from the plumb plane running through the real wheel axials. The spacing distance E between the platform-parallel plane D of the and the outer tangent of the caster wheels sets an angle of inclination C from level ground when the platform is in the open position. The angle of inclination C, suitably equal to the angle G of deviation, helps keep the additional articles from sliding of the platform even if unsecured.

DETAILED DESCRIPTION OF THE INVENTION

Figure 1:
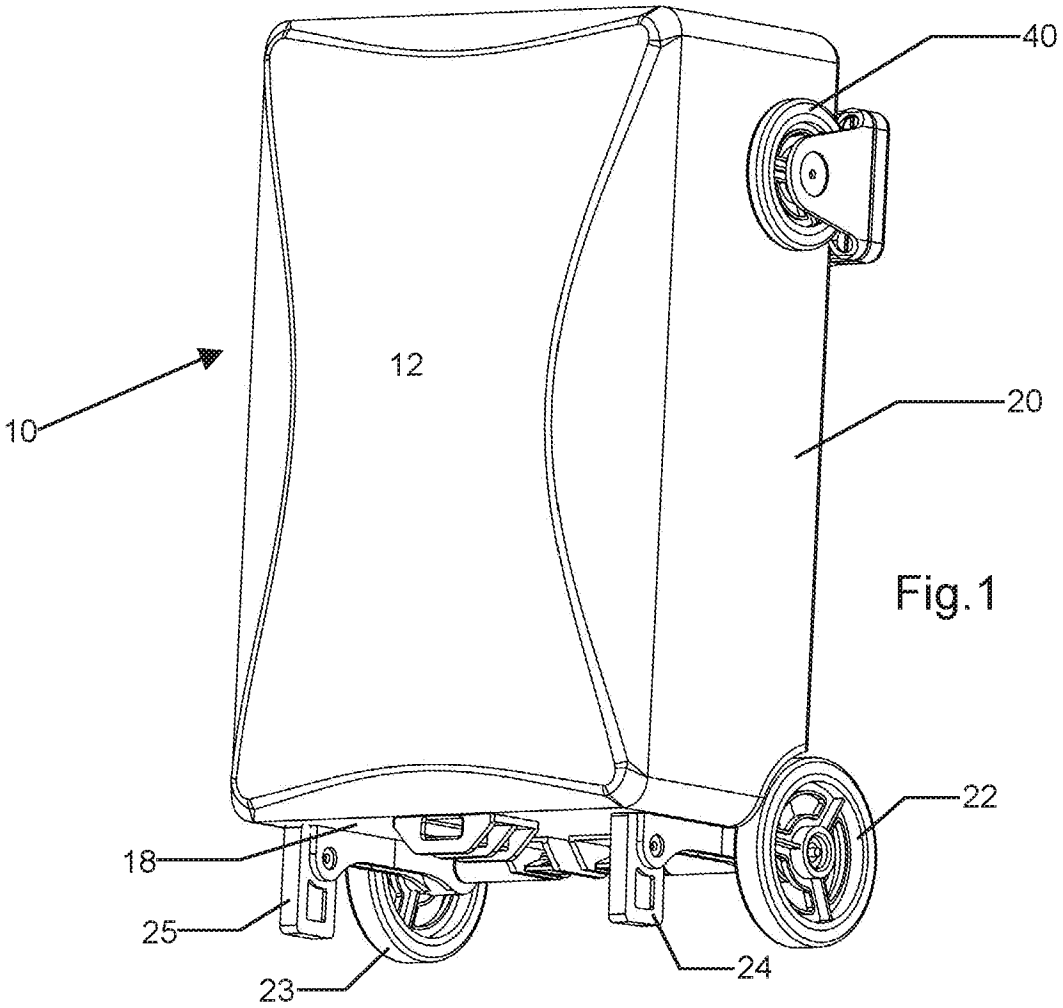
FIG. 1 is a perspective view showing the front, a side and a portion of the bottom of a luggage embodiment of the invention with the platform its closed position.
Figure 2:
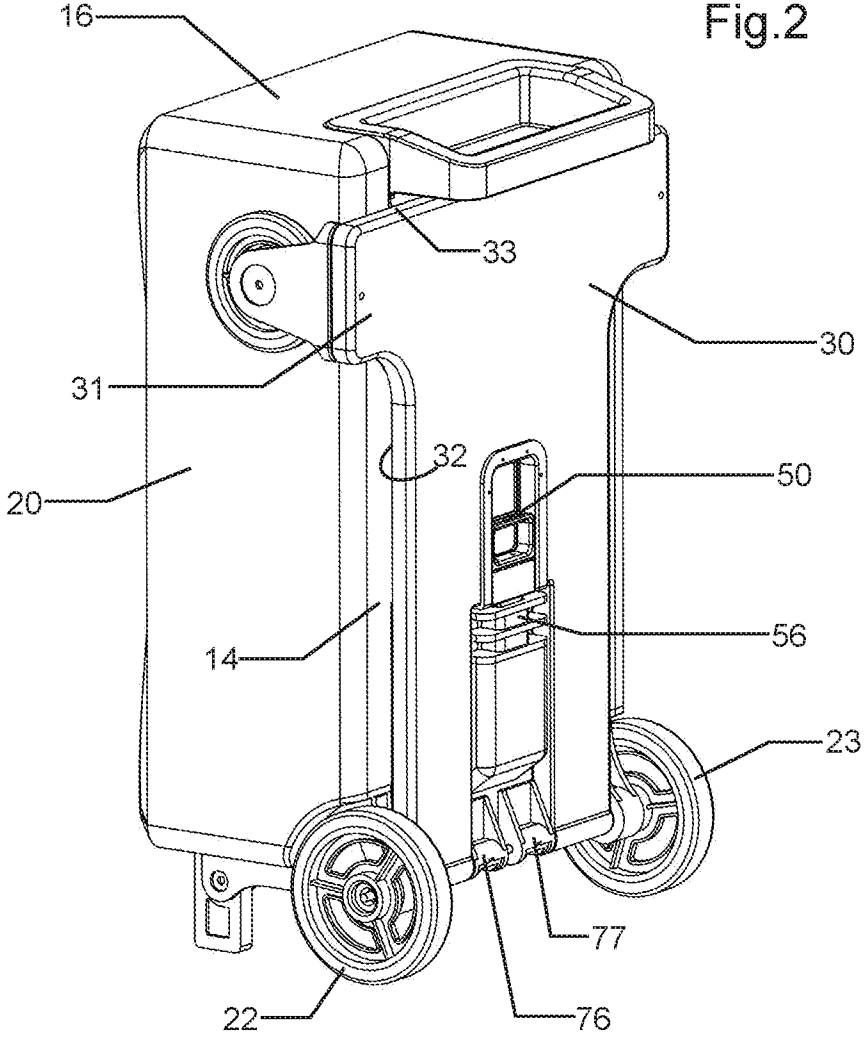
FIG. 2 is a perspective view showing the back, the same side and the top of the embodiment of the invention shown in FIG. 1.
Figure 3:
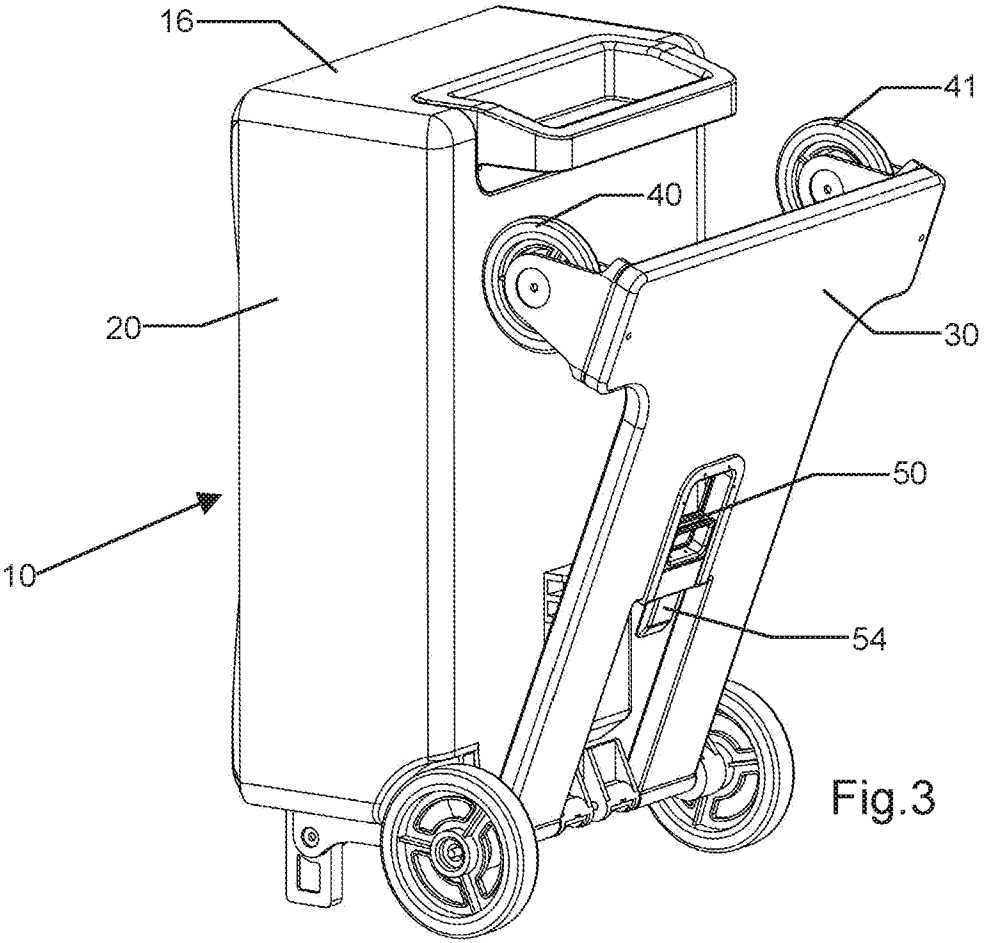
FIG. 3 is a view showing similar perspective as FIG. 2, except that the inventive platform has been unlatched and partially rotated toward its open position.

All published documents cited herein are incorporated herein by reference in their entirety.

In the several figures the same numerals are used to show the same parts in multiple views. The embodiment illustrated in the figures is a preferred embodiment of rollable luggage case designated by the numeral 10. The case 10 includes a generally box-like container for the possessions being transported having front side 12, backside 14, top side 16, bottom side 18, and two depth-sides 20, only one of which is shown. Two wheels 22, 23 at the bottom rear make the luggage case rollable. The luggage case shown is suitably dimensioned for checked luggage (62" total L+W+H), although it may also be dimensioned for carry-on luggage, or over-sized luggage without departing from the invention. In alternate embodiments configured for tool chests and the like likewise, the dimensions are adapted to the ordinary practical constraints imposed on the particular use of the device.

The bottom rear wheels 22, 23 are mounted on a common axis with a platform 30. The platform 30 is rotatable about said axis from a closed position adjacent the backside 14 of the luggage case about a rotation angle A of 270° to an open position adjacent the bottom side 18 of the luggage case. The 270° rotation angle is set assuming right angles between the bottom and back sides of the container. These can of be modified to some extent, so the 270° rotation angle should be taken as approximate. The platform 30 has an outer surface 31 onto which additional articles such as second items of luggage, personal items such as purses and computers, and the like, may be loaded when the platform 30 is in open position. The platform 30 also has an inner surface 31 adjacent the back side 14 when the platform is in closed position, and an upper edge 33.

To stabilize the luggage when standing with platform 30 in the closed position, the front bottom is provided with a pair of lugs 24, 25. The lugs can be permanently mounted or molded in place, or replaced by caster wheels or rollers, not shown. In the embodiment depicted, the lugs 24, 25 can be pivoted against bottom side to increase clearance under the bottom when the platform 30 is in its open position. Higher bottom clearance facilitates moving on uneven surfaces and crossings of transitions between different flooring surfaces such as occur between carpeting and marble flooring.

Figure 7:
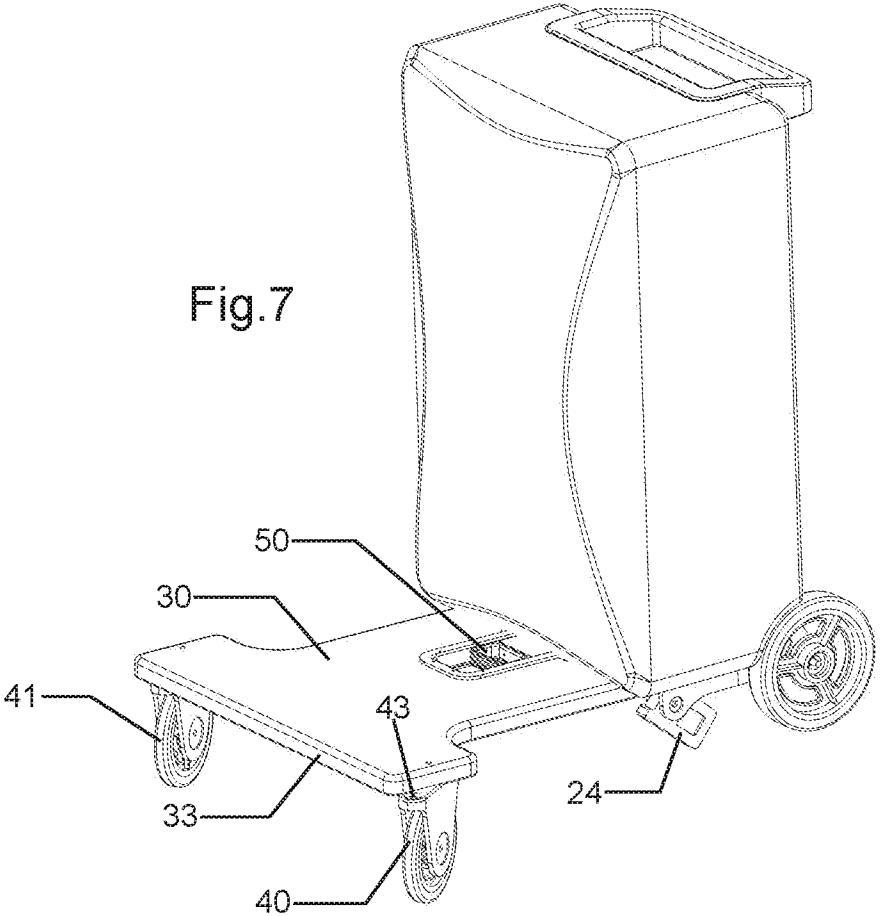
FIG. 7 is a perspective view showing the front, side and the top of the embodiment of FIG. 1 in the open position, with the lugs partially retracted and the caster wheels swiveled.
Figure 8A:
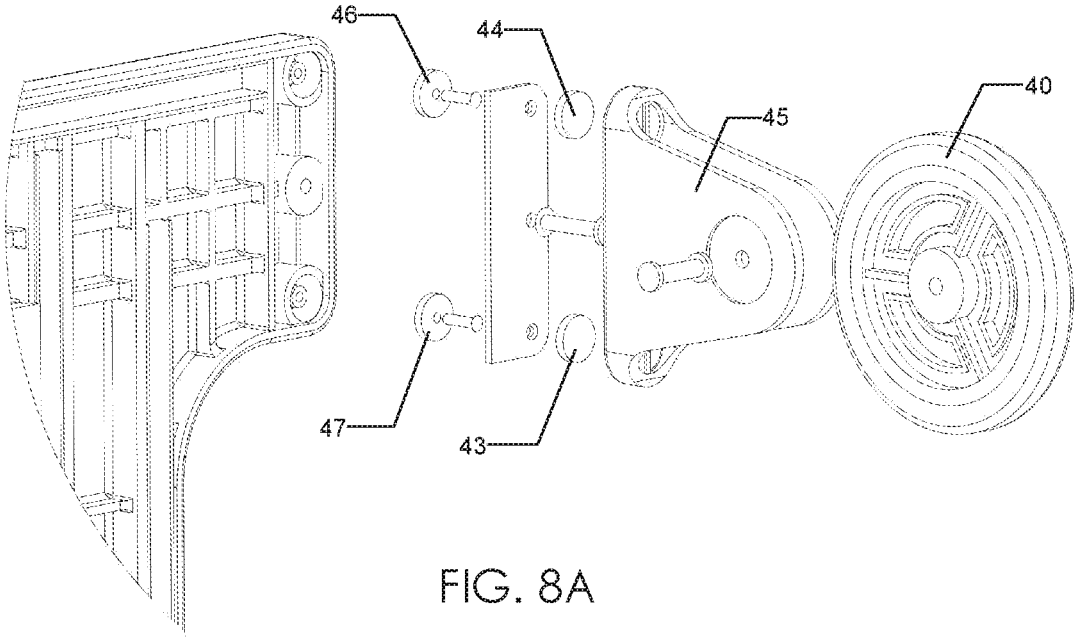
FIG. 8A is an exploded detail view and of a caster wheel and a portion of the platform to which it attaches.

The platform 30 includes a top edge side edges and a pair of caster wheels 40, 41 mounted near the top edge along the side. The platform can be generally T-shaped to minimize weight and accommodate pivoting around its axis of rotation as described later. The platform 30 includes caster wheels 40, 41 are mounted to the cross of the T. In the embodiment shown the caster wheels 40, 41 project inward from the platform alongside the depth sides of the case. In alternate embodiments, not shown, the case may be provided with indents in the back side into which the caster wheels project in the closed position. When the platform is in the open position the caster wheels project downward from the platform and are free to swivel about respective axes as shown in FIG. 7. Alternate shapes for the platform, such as simple rectangle, or hollow beams may be employed in alternate embodiments. In still further alternates the platform includes retractable drawer-slides for extending its length when in the open position.

Figure 8:
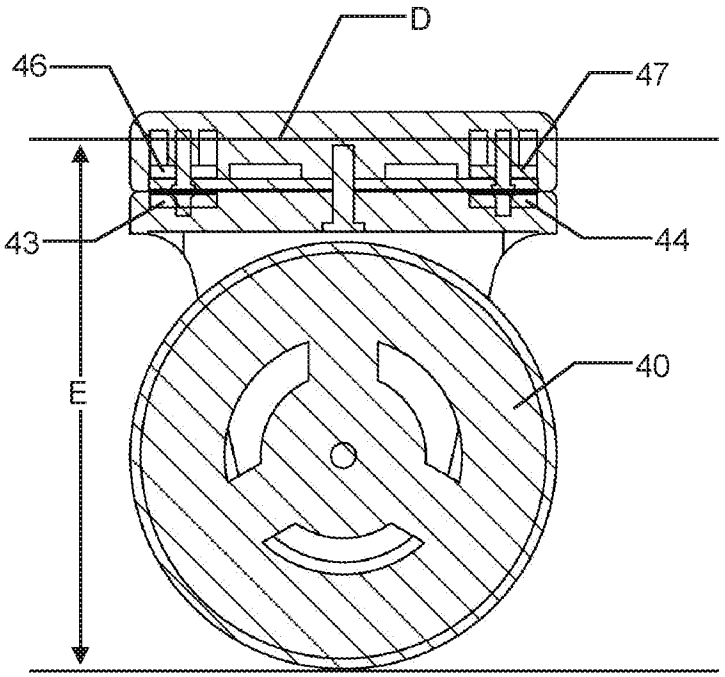
FIG. 8 is a fragmentary cross-section of a caster wheel in the closed position.
Figure 6:
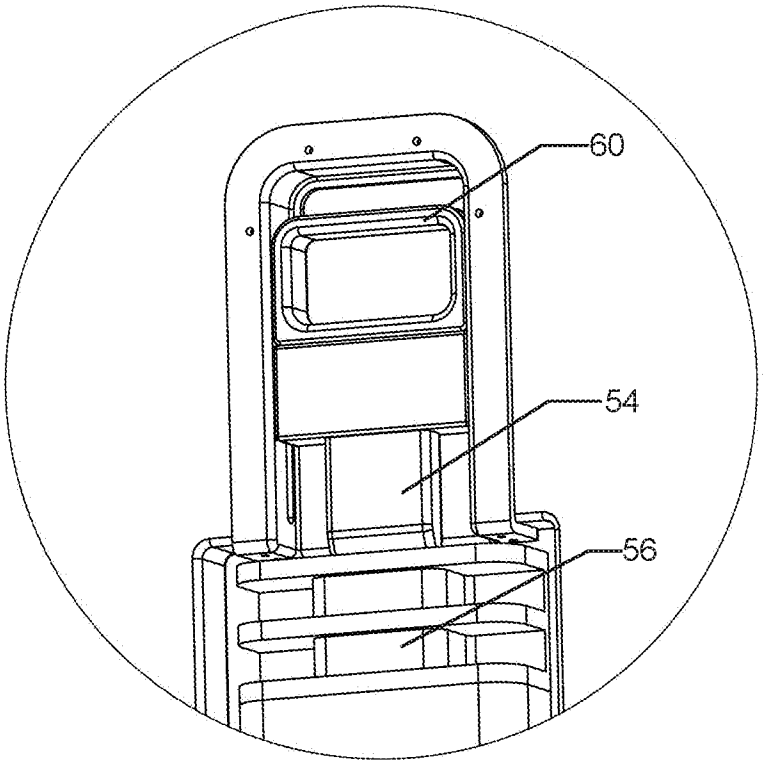
FIG. 6 is an enlarged fragmentary view of the latch assembly in the closed position with the latch handle retracted to release the platform for rotation.

In some embodiments, the caster wheels 40, 41 are parallel to the side 20 when the platform is in the open position, in a manner similar to that described in U.S. Pat. No. 4,054,965 incorporated herein by reference, or in the similar manner shown in FIG. 8. Referring to FIG. 8, the caster wheel assembly included the caster wheel 40 pivotably mounted with a pair of caster wheel magnets 43, 44 and fixed caster frame magnets 46, 47 of opposite poles to the wheel magnets 43, 44. As shown in FIG. 7, the caster wheels 40, 41 are free to swivel while the caster wheels are in contact with the ground with the platform 30 in the open position. The swivel direction will follow the direction in which the luggage is pushed or pulled When the casters are off the floor the attracting force between the two magnets of opposite polarity pulls the wheel to automatically lock the caster in parallel line with the respective depth sides 20 of the case 10.

The case 30 includes an integral push-pull handle 50 by means of which the case can be pulled when the case is in the closed position or both pushed and pulled when the platform is in the open position. The handle 50 can of course replaced with a retractable handle as is common with many rollable cases.

To hold the platform in its closed and open positions the platform is provided with a. latch mechanism which engages locking structures on the back and bottom of the case, respectively. In the embodiment shown, the latch mechanism has a spring loaded male portion 54 that engages female member 56 in the closed position and female member 58 when in the open position. The male member is attached to a latch handle 60 that is accessible from side 31 of the platform. The latch handle 60 when pulled in a direction toward top edge 33 causes the male member move upward sufficient to clear the female member and thereby allow rotation about the platform axis.

When the platform reaches the open position, the latch handle 60 is still accessible from the outer side 31 of the platform. To latch platform 30 in the open position the latch handle is again pulled in the direction of platform upper edge 33 to clear the bottom female member 58 and then released so that the spring-bias of the male member causes it to engage the bottom female member. In the embodiment shown, the latch handle 60 is accessible from both outer side 31 and inner side 32. This allows the latch to be engaged or released from the female member 58 as is found convenient by the user.

To rotate the platform between the open and closed positions, the case is suitably tilted to put one of the depth sides 20 on the floor. The latch can be released and the platform can be rotated freely from that position.

Figure 5:
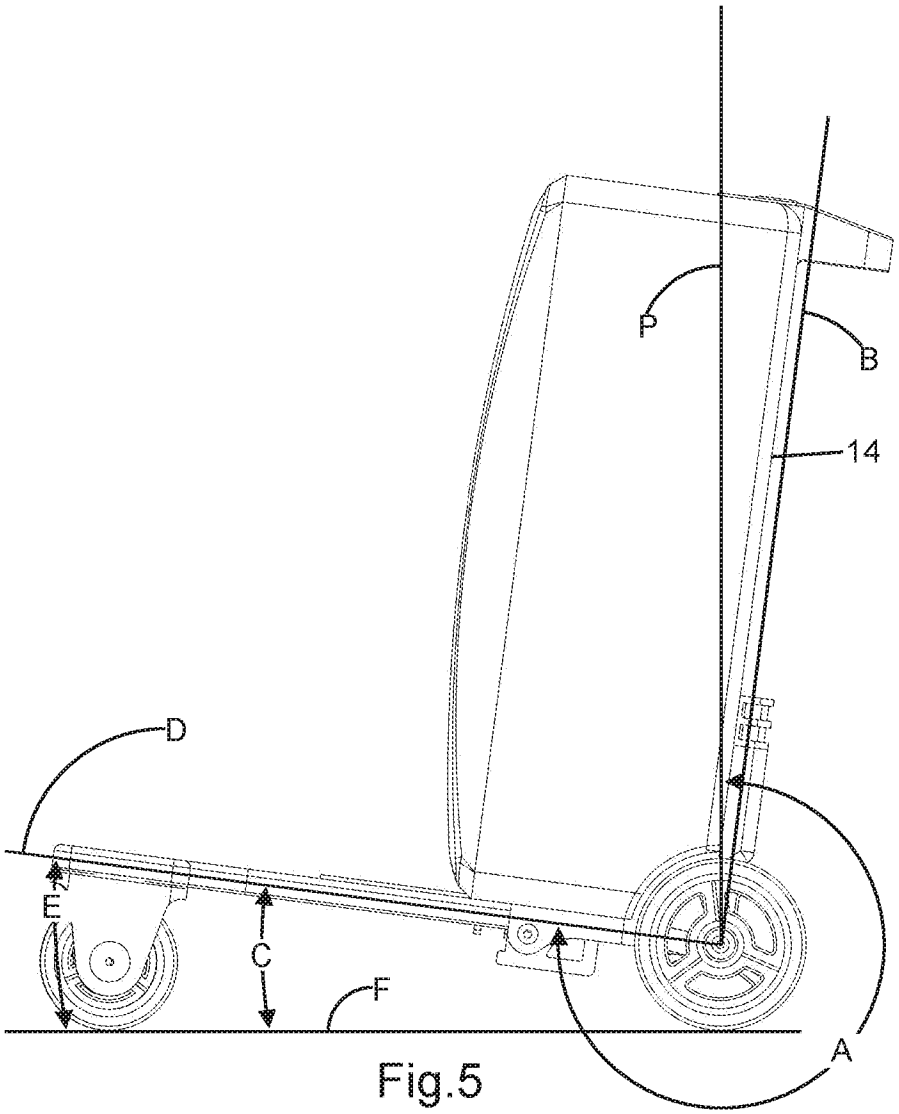
FIG. 5 is a side view of the embodiment of FIG. 1 in the open position, showing ground and plumb lines and the change in angles as described herein.
Figure 4:
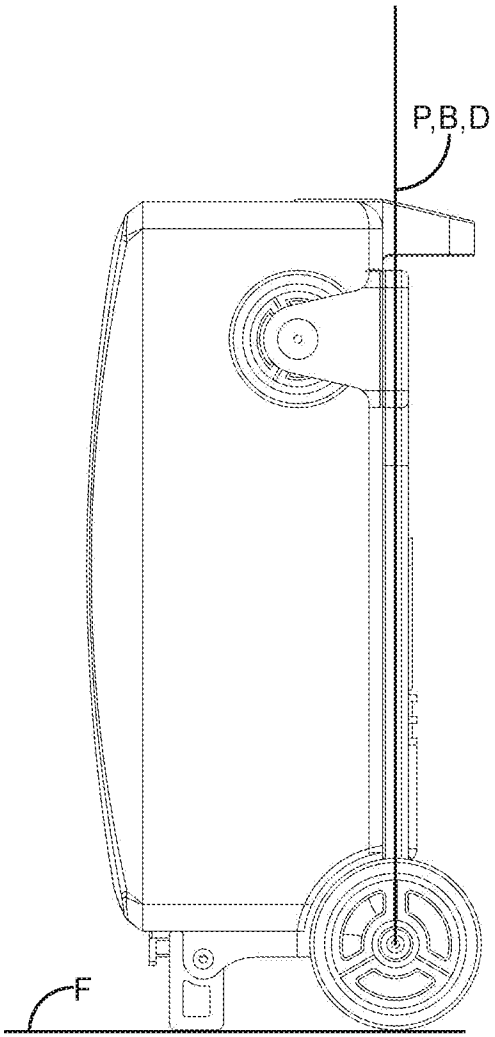
FIG. 4 is a side view of the embodiment of FIG. 1 in the closed position showing ground and plumb lines.

Referring to FIGS. 4 and 5, embodiments, a back-parallel plane B, runs through the rear wheel axis parallel to the back side 14. A plumb plane P, plumb to the floor plane F also runs through the rear wheel axis when the platform is in the closed position. A platform-parallel plane D runs through the rear wheel axis and is parallel to the outer surface 31 of the platform. In the closed position shown in FIG. 4 the planes B, are coplanar. When the platform is rotated to the open position the back-parallel plane B axis deviates from the plumb plane P by several degrees, suitably from about 5°-10°, or about 7°-8° in the direction of rotation of the platform as shown In FIG. 5. This deviation angle G allows the device to more easily be pushed and pulled when the platform is loaded.

The angle of rotation of the plane D is shown as angle A in FIG. 5. Suitably it is about 270°. The distance E of the caster wheels from the platform plane line D to the outer tangent of the caster wheels determine the angle of inclination C from flooring plane F for the platform outer surface 31 in the open position. The angle of inclination C, equal to the deviation angle G, when the back side 14 and bottom side 18 are at conventional right angles, helps keep the additional articles from sliding of the platform even if unsecured. In practice the additional articles can be readily secured by bungee cords or straps not shown. Securing cords or straps which may optionally be transported separately, e.g. in exterior pockets of the luggage case or in such additional items or they may be provided attached to the platform.

Figure 9:
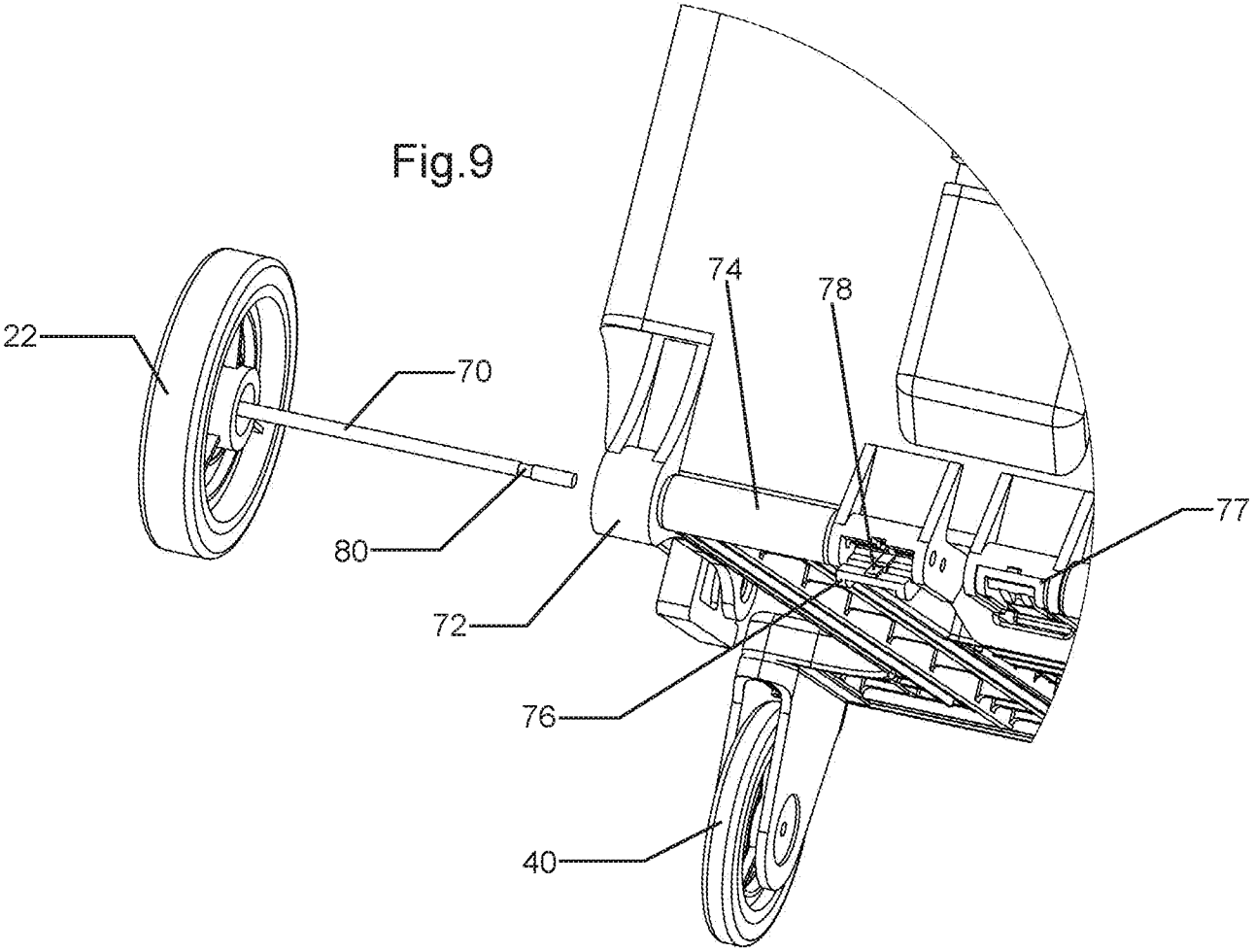
FIG. 9 is a partial detail view showing a mechanism for optional removal of a roller wheel which allows the platform to be removed from the luggage.

Referring to FIG. 9 there is shown a partial detail view showing a mechanism for optional removal of the wheel 22, The wheel 22 is fixedly attached to an axle rod 70 which passes through case bearing portion 72 fixed to the case 10 and platform bearing portion 74. A pivotable axle engagement member 76 also fixedly attached to the case includes projections 78 which extend into a groove 80 in the axle 70 when engagement member closed. Pivoting the engagement member to its disengagement position as shown in FIG. 9 allows the wheel and axle rod to be removed. A like engagement member 77 for engaging wheel 23 and its axle, not shown, is shown in FIG. 9, in its engagement position. Concurrent removal of both wheels 22 and 23, with their axles, frees the platform 30 from its attachment to the case 10. Replacement of the wheels and their axles, without the platform in place with repositioning the of the engagement members 76, 77 to their respective engagement positions, allows the case 10 to be used as a traditional roller case in the event that particularities of a particular trip, such as weight restrictions or lack of additional items, make its use undesirable or unnecessary.

In further embodiments, the platform 30 may have projectable segments connected by drawer slide mechanism analogous to the bottom platform slides utilized in US 2011/0247910.

LIST OF REFERENCE NUMERALS USED rollable luggage case 10.
front side 12
backside 14
top side 16
bottom side 18
depth-sides 20
rear wheels 22, 23
lugs 24, 25
platform 30.
platform outer surface 31
platform inner surface 32
platform upper edge 33
caster wheels 40, 41
caster wheel magnets 43, 44
fixed caster frame magnets 46, 47
push-pull handle 50
latch mechanism male portion 54
latch mechanism female member 56
latch mechanism female member 58
latch mechanism handle 60
back-parallel plane B,
plumb plane P
floor plane F
platform-parallel plane D
deviation angle G
rotation angle A
caster spacing distance E
Inclination angle C
axle rod 70
case bearing portion 72
platform hearing portion 74
axle engagement members 76, 77
axle engagement member projection 78
axel groove 80

The invention claimed is:

1. A rollable personal container transport device (10) comprising a container for items to be transported, and a platform (30) that is rotatably movable from a closed position adjacent a back side of the container to an open position under a bottom side (18) and extending beyond a front of the container to provide a surface for carrying additional items.

2. A device as in claim 1 further comprising a pair of caster wheels (40, 41) mounted on the platform at an upper side of the platform in the closed position which project downward to contact the ground when the platform is in the open position.

3. A device as in claim 2 wherein when the platform (30) is in the open position the casters project downward from the platform a distance (E) which causes a platform-parallel plane (E) which extends through said common axis and parallel to an outer surface (31) of the platform to be disposed at an angle (C) relative to a ground plane (F).

4. A device as in claim 2 wherein said casters magnetically align parallel to edge sides (20) when the device is in the closed position.

5. A device as in claim 1 wherein a plumb plane (P) running plumb through the rear wheel axis, a back-parallel plane (B) running through the rear wheel axis and parallel to the back side, and a platform-parallel plane (E) running through the rear wheel axis and parallel to the plane defined by an outer surface (31) of the platform are coplanar when the platform (30) is in the closed position.

6. A device as in claim 5 wherein in the open position the platform-parallel plane (E) is disposed at an angle (C) from the plane (F) of ground level.

7. A device as in claim 6 wherein said angle (C) is in the range of from 5° to 10°.

8. A device as in claim 1 further comprising a latch mechanism (54, 56, 58, 60) which holds the device in said closed and open positions, respectively and which is releasable to allow said rotation between the closed and open positions.

9. A device as in claim 1 further comprising a mechanism for removing the platform which still allows the device to be used as a rollable personal container transport device.

10. A rollable personal container transport device (10) comprising a container, and a platform (30) that is rotatably movable from a closed position adjacent a back side of the container to an open position extending beyond a front of the container to provide a surface for carrying additional items, and said platform (30) is mounted on the device on a common axis with a pair of rear wheels (22, 23) that allow the device to roll when the platform is in the closed position.

11. A device as in claim 10 wherein said rear wheels (22, 23) are disposed on separate axles (70).

12. A device as in claim 11 further comprising axle engagement mechanism that allows for removal of the wheels and platform followed by replacement of the wheels without the platform to provide a device that remains a rollable transport device.

13. A rollable luggage case (10) comprising a generally box-like container for possessions being transported having a front side (12), backside (14), top side (16), bottom side (18), and two depth-sides (20), a pair of rear wheels (22, 23) mounted on a common axis, attached to the bottom rear of the container, and a platform (30) rotatable about said common axis from a closed position adjacent the back side (14) to an open position adjacent the bottom side (18).

14. The rollable luggage case of claim 13 further comprising a pair of caster wheels (40, 41) at an upper side of the platform in the closed position which project downward to contact the ground when the platform is in the open position.

15. A rollable luggage case as in claim 14 wherein, when the platform (30) is in the open position, the casters project downward from the platform a distance (E) that causes a platform-parallel plane (E) which extends through said common axis and parallel to an outer surface (31) of the platform to be disposed at an angle (C) relative to a ground plane (F).

16. A rollable luggage case as in claim 15 wherein said angle (C) is from about 5° to about 10°.

17. A rollable luggage case as in claim 14 wherein said casters magnetically align parallel to said edge sides (20) when the platform is in the closed position.

18. A rollable luggage case as in claim 13 further comprising a mechanism for removing the platform from said box-like container which still allows the case to be used as a rollable luggage.

19. A rollable luggage case as in claim 18 wherein the rear wheels (22, 23) are mounted on separate detachable axles (70).

20. A rollable luggage case as in claim 13 wherein the platform is releasably securable in said open and closed positions, respectively.

* * * * *